US006497983B2

(12) United States Patent
Iwa et al.

(10) Patent No.: US 6,497,983 B2
(45) Date of Patent: Dec. 24, 2002

(54) TONER BINDER FOR ELECTROPHOTOGRAPHY AND TONER FOR ELECTROPHOTOGRAPHY

(75) Inventors: Tsuyoshi Iwa, Chiba (JP); Kazuya Sakata, Chiba (JP); Shoji Kawasaki, Chiba (JP); Masaaki Shin, Chiba (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 09/974,893

(22) Filed: Oct. 12, 2001

(65) Prior Publication Data

US 2002/0076637 A1 Jun. 20, 2002

(30) Foreign Application Priority Data

Oct. 12, 2000 (JP) ..... 2000-312017

(51) Int. Cl.[7] ..... G03G 9/087

(52) U.S. Cl. ..... 430/109.2; 430/109.3; 430/111.4

(58) Field of Search ..... 430/109.2, 109.3, 430/111.4

(56) References Cited

U.S. PATENT DOCUMENTS

| | | | | |
|---|---|---|---|---|
| 4,963,456 A | | 10/1990 | Shin et al. | |
| 4,966,829 A | | 10/1990 | Yasuda et al. | |
| 5,084,368 A | | 1/1992 | Hirayama et al. | |
| 6,114,076 A | * | 9/2000 | Odell et al. | 430/109.4 |
| 6,121,364 A | * | 9/2000 | Yeates et al. | 524/458 |

FOREIGN PATENT DOCUMENTS

| | | |
|---|---|---|
| JP | 53-079810 | 1/1980 |
| JP | 54-056535 | 11/1980 |
| JP | 05-008979 | 1/1994 |
| JP | 05-008980 | 8/1994 |
| JP | 08-131648 | 12/1997 |

* cited by examiner

*Primary Examiner*—John Goodrow
(74) *Attorney, Agent, or Firm*—Burns, Doane, Swecker & Mathis, LLP

(57) ABSTRACT

The present invention is aimed at providing a toner binder for electrophotography that is excellent in the fixing property, offset resistance, blocking property, grindability, durable developing property and the like to correspond to the high-speed movement of a copier.

The purpose of the present invention could be achieved by a toner binder having the following features for electrophotography. That is, when the viscoelasticity of the toner binder is measured in the temperature range of 50 to 200 ° C. and at a heating rate of 2° C./min., the viscoelasticity curve in the temperature range of 100 to 200° C. showing the relationship between the storage modulus and temperature, in which curve the axis of ordinate is the logarithm (Pa) of storage modulus G' and the axis of abscissa is temperature (° C.), has a concave in the temperature range of 140 to 180° C. and has a minimum value of storage modulus G' at the bottom of the range, and this G' 0 and storage modulus G' 200 at 200° C. are G' 0<G' 200 and the difference ΔG' (G' 200−G' 0=ΔG') is 300 Pa or more.

10 Claims, 4 Drawing Sheets

TONER BINDER FOR ELECTROPHOTOGRAPHY AND TONER FOR ELECTROPHOTOGRAPHY

BACKGROUND OF THE INVENTION

1. Field of the Invention

The present invention relates to a toner binder for electrophotography to develop electrostatic charge images in electrophotography, electrostatic record, electrostatic printing and the like, and more particularly to a toner for electrophotography that can correspond to a high-speed copier and has high resolution and high image quality, and that is excellent in grindability.

2. Description of the Prior Art

Generally, the method of using electrophotography in a PPC copier or a printer in which a toner image formed on a photo conductor is transcribed on a recording paper (Plain Paper Copy Method) is carried out in such a method that an electrostatic latent image is formed on a photoconductor, then the latent image is developed with toner, and after the toner image is transcribed on a sheet to be fixed like paper and others, the transcribed image is fixed by heating with a heating roll. Because fixing is carried out under heating and pressure, this method can be conducted rapidly and is extremely excellent in heat efficiency. Consequently, the fixing efficiency is very good. However, in this heating roll method, though the heat efficiency is very good, on the other hand, there is such a problem that since toner is contacted with the surface of the heating roll in the melt state of the toner, the toner is transferred by adhering on the surface of the heating roll, and the transferred toner is transferred again on the next sheet to be fixed to contaminate it (an offset phenomenon)

The offset is prevented by, for example, applying silicone oil on the surface of a heating roll with cloth or paper. In this case, the method is very effective in preventing the offset of toner, but because a device is needed to supply a liquid for preventing the offset and the installation of machinery becomes complicated, the repair and management of the machinery becomes complicated to result in an increase in cost, so it is not preferable to adopt such a means. Further, silicone oil and the like may be evaporated by heat to contaminate the inside of the machinery.

Consequently, it is desired to develop toner for a high-speed machine (an oilless fixing method) in a method that is not needed to apply the above-mentioned silicone oil and the like (an oilless fixing method).

On the other hand, a copier is pointed to the direction of high speed, and as a result, the speed of a fixing roll is inevitably high and toner is required to be fixed by heating in a short time. It is necessary for toner to have high fluidity in its melt state in order to be fixed in a short time. Although it is generally effective to lower the glass transition temperature (hereinafer referred to as Tg) of a resin to be used as toner in order to improve the fixing property, on that account there may occur such an undesirable phenomenon as the blocking of toner during storage.

On the other hand, many proposals have been made about toner with the use of a crosslinked polymer as a method for preventing the offset in the development of toner for an oilless fixing method. For example, a method using a crosslinked polymer produced in an emulsion polymerization has been disclosed in Japanese Patent Publication No. 60-36582. In this case, the crosslinked polymer to be used contains 50 to 99 mass % gel part, and when the content of the gel part is increased, the offset resistance is improved but the grindability is worsened, while when the content of the gel part is decreased, the grindability is improved but the offset resistance is worsened. As a result, it was extremely difficult to satisfy both the offset resistance and the grindability.

Moreover, in this method, it is necessary to use a dispersing agent or a dispersing auxiliary agent together to stabilize the emulsified particles when the crosslinked polymer is produced. Since these dispersing agents are highly hygroscopic and adversely affect electric properties, especially charge stability, it is necessary to remove these dispersing agents as much as possible after the crosslinked polymer is produced. However, much labor is required to remove them, and the amount of drainage from the washing facility is also large and needs heavy treatment. Furthermore, U.S. Pat. No. 4,966,829 discloses that it is good to use toner containing a vinyl-based polymer that contains 0.1 to 60 mass % gel component and the molecular weight of the main peak is 1,000 to 25,000 in the soluble part in tetrahydrofuran and that has at least one subpeak or a shoulder in the molecular weight area of 3,000 to 150,000. However, because the method of producing this polymer is a suspension polymerization and also in this case, dispersing agents or dispersing auxiliary agents are used together similarly to an emulsion polymerization, there was the same problem as that in the above-mentioned emulsion polymerization. For this reason, the present inventors have developed a resin by a solution polymerization as toner with a good fixing property (U.S. Pat. No. 4,963,456).

In resin produced by a solution polymerization, the solvent will be removed after the polymerization is ended. Since all of the low volatile components, including unreacted residual monomers and decomposition products of the initiator, can be removed at this time, it is considered that an optimal resin for toner, that is, a homogeneous resin that contains a very low amount of impurities and is electrically stable can be obtained. However, in the production of a crosslinked polymer by a solution polymerization method, there was such a problem that the production became difficult to be performed because of the occurrence of the Weissenberg effect (resins are coiled round a stirring rod). Accordingly, the present inventors have further developed a method of producing a polymer having as high a molecular weight as possible by a bulk polymerization and the like (U.S. Pat. No. 5,084,368). However, there is a limit to the molecular weight of a polymer to be produced, and the offset property had not been conquered completely.

Further, although it is disclosed in Japanese Patent Publication No. 60-38700 that a toner binder produced by heating and mixing a copolymer (A) having 3 to 40% a monomer containing glycidyl group and a crosslinking compound (B) is good, this toner had such a problem in its durability that oppositely charged toner was occurred in a long-term test because of many residuals of epoxy groups.

Furthermore, the present inventors have developed a technique to obtain excellent toner by crosslinking a resin having carboxyl groups produced by a solution polymerization and a compound having a glycidyl group in a specific ratio (Japanese Patent Laid-Open No. 06-011890 and Japanese Patent Laid-Open No. 06-222612). Thus obtained toner can correspond to a high-speed machine, has a good balance of the fixing property, the offset resistance and the blocking property, and is excellent in grindability, production efficiency, electrical properties and charge stability. However, there occurred a problem that because the crosslinking component was subjected to excessive shear to cut gels during kneading in the production step of toner, the elasticity of the toner came to be insufficient at high temperatures, resulting in the worsening of an image after fixing and the failure of obtaining sufficient offset effect.

The present inventors have eagerly studied these requirements to satisfy them, resulting in the development of a technique to obtain an excellent toner binder by improving the molecular weight and epoxy value of a crosslinking agent containing a glycidyl group (Japanese Patent Laid-Open No. 09-319140). Thus obtained toner binder can decrease the cutting of gels during kneading in the production step of the toner, has good effectiveness in the durable developing property and offset resistance, has a greatly improved balance of the fixing property, offset resistance and the blocking property, and is excellent in grindability, production efficiency, electrical properties, and charge stability.

However, at present, marketing needs are pointed toward further high speed and new energy-saving techniques. As a result, it is needed to further lower fixing temperature for the shortening of heating time by high speed technique and to lower even more fixing temperature for energy-saving. That is, since the requirement of the fixing property at further lower temperatures has become strong, it has become difficult to satisfy both requirements of the fixing property at further lower temperatures and the offset resistance needed at the same time by the above-mentioned techniques.

SUMMARY OF THE INVENTION

Considering the improvement of the fixing property at lower temperature and the improvement of the balance of the fixing property and the offset resistance with the needs of higher speed and the newly required energy-saving as mentioned above in the copier market as main subjects, it is the object of the present invention to improve all the capabilities of toner for electrophotography, including the fixing property, the offset resistance, the blocking property, the grindability, and the durable developing property.

The present inventors have eagerly studied these requirements to satisfy them and found that in the production of a toner binder for electrophotography that would be obtained by crosslinking a cross linking compound and a copolymer, making the toner binder for electrophotography by stopping the crosslink reaction in the middle of the reaction would improve the fixing property through making the binder lower-viscosity and also improve the offset property by causing the crosslink reaction during of fixing with this remaining crosslink reactivity, and that the grindability, the blocking property and the durable developing property could be improved at the same time. That is, it has been achieved to complete a technique of obtaining a toner binder for electrophotography, which can correspond to a high-speed machine and is excellent in the fixing property, the offset resistance, the blocking property, the grindability and the durable developing property, by making the viscoelasticity curve be concave in the range of 140° C. to 180° C. and making a minimum value of G' 0 be present at the bottom of the range, and by specifying the difference between the above described minimum value G' 0 and storage modulus G' 200 at 200° C.

That is, the present invention can be specified by the matters described in the following.

(1) In a toner binder for electrophotography, wherein when the viscoelasticity of the toner binder is measured in the temperature range of 50 to 200° C. and at a heating rate of 2° C./min., the viscoelasticity curve in the temperature range of 100 to 200° C. showing the relationship between the storage modulus and temperature, in which curve the axis of ordinate is the logarithm (Pa) of storage modulus G' and the axis of abscissa is temperature (° C.), has a concave in the temperature range of 140° C. to 180° C. and has a minimum value of storage modulus G' at the bottom of the range, this G' 0 and storage modulus G' 200 at 200° C. have a relationship of G' 0<G' 200 and the difference ΔG' (G' 200−G' 0=ΔG') is 300 Pa or more.

(2) The toner binder for electrophotography described in (1), wherein the above described storage modulus G' 200 at 200° C. is 1000 Pa or more.

(3) The toner binder for electrophotography described in (1) or (2), wherein the toner binder has a glass transition temperature of 45 to 75° C., contains 0.1 to 20 mass % gel part, and has a peak in the molecular weight area of 4,000 to 50,000 in the molecular weight distribution based on gel permeation chromatography (GPC) of the soluble part of the toner binder in tetrahydrofuran (THF).

(4) The toner binder for electrophotography described in any one of (1) to (3), wherein the degree of crosslinking reaction is 1 to 50%.

(5) The toner binder for electrophotography described in any one of (1) to (4), wherein the toner binder is obtained by heating and melting a vinyl resin (A) containing glycidyl groups, the weight-average molecular weight of which resin is 10,000 to 100,000 and the epoxy value of which resin is 0.005 to 0.1Eq/100g, and a vinyl resin (B) containing carboxyl groups, the acid value of which resin is 1 to 30 mg KOH/g and the glass transition temperature of which resin is 40 to 70° C., to be crosslinked by the use of the above described vinyl resin (A) containing glycidyl groups as a crosslinking agent.

(6) The toner binder for electro photography described in any one of (1) to (5), wherein one of styrene-acrylic resins is a main component.

(7) Toner for electrophotography, wherein the toner binder for electrophotography described in any one of (1) to (6) is used.

DETAILED DESCRIPTION OF THE INVENTION

Figure 1:
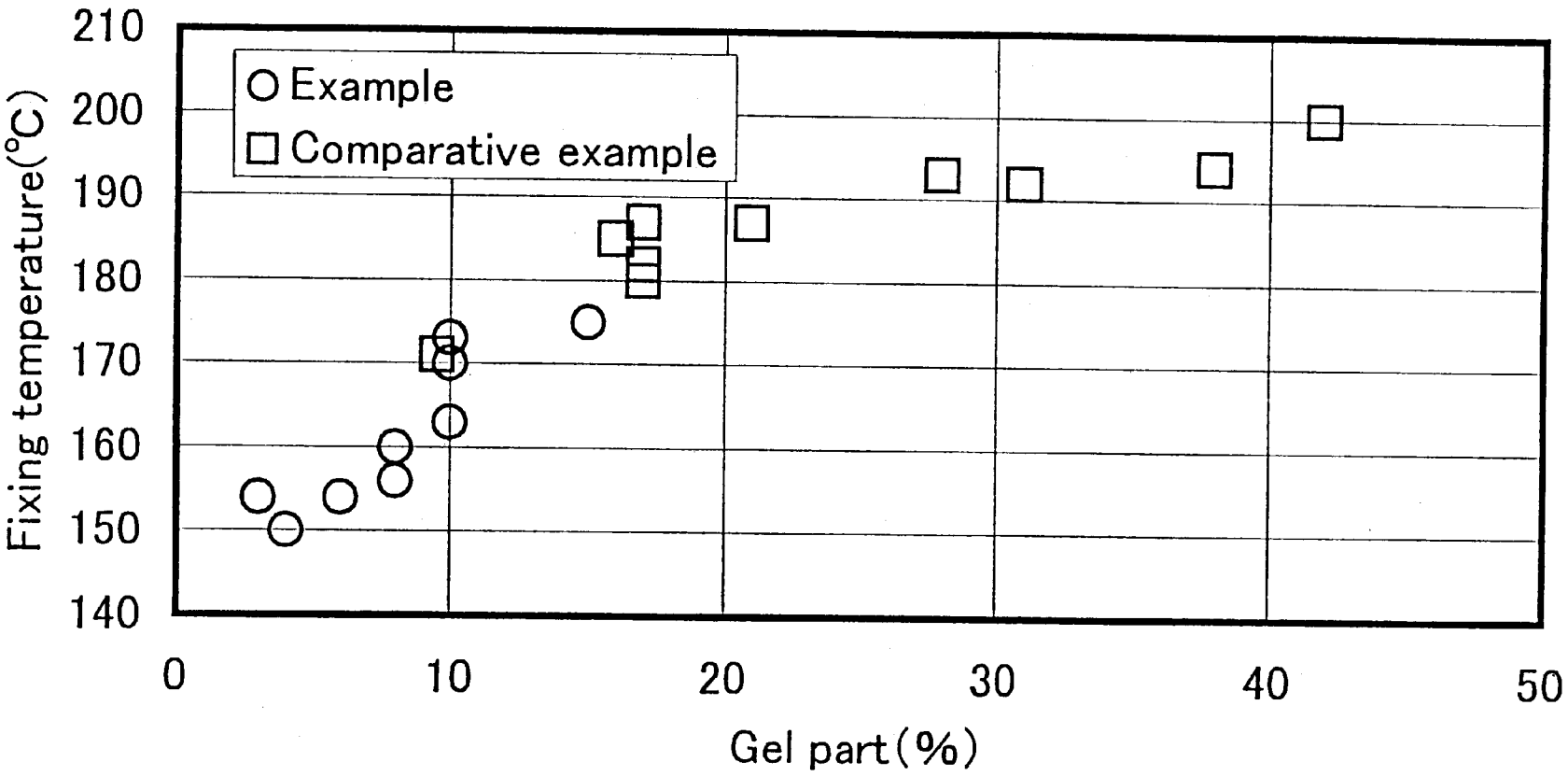
FIG. 1 is a figure showing the relationships between gel part and fixing temperature in examples and comparative examples.

A vinyl resin (A) containing glycidyl groups in the present invention is a resin obtained by copolymerizing a vinyl monomer containing a glycidyl group and another vinyl monomer, and as a vinyl resin (A) containing glycidyl groups, such polymers are preferable that has a weight-average molecular weight of 10,000 to 100,000, preferably 15,000 to 85,000, and more preferably 25,000 to 75,000, and has an epoxy value of 0.005 to 0.1 Eq/100 g, which is measured according to JIS K 7236. If the weight-average molecular weight is less than 10,000, there can be seen a tendency of gels to be easily cut during kneading in the production process of toner for electrophotography and also seen a tendency of the durable developing property and offset resistance to be lowered after fixing. If the weight-average molecular weight is over 100,000, there can be seen a tendency of the fixing property to be lowered. And, the epoxy value is more preferable to be in the range of 0.01 to 0.1 Eq/100 g. If the epoxy value is less than 0.005 Eq/100 g, there can be seen a tendency of the production amount of gels to be decreased and a tendency of the offset resistance to be lowered. If the epoxy value is over 0.1 Eq/100 g, there can be seen a tendency of gels to be easily cut during kneading in the production process of toner for electrophotography and also seen a tendency of the durable developing property and offset resistance to be lowered.

A vinyl resin (B) containing carboxyl groups in the present invention is a resin obtained by copolymerizing a vinyl monomer containing a carboxyl group and other vinyl monomer, and a vinyl resin (B) containing carboxyl groups is preferable to be a resin that has an acid value of 1 to 30 mg KOH/g, which is measured according to JIS K 5407, and has a Tg of 40 to 70° C., which is measured according to JIS K 7121. And a resin having an acid value of 5 to 25 mg KOH/g and Tg of 50 to 60° C. is further preferable. If Tg is less than 40° C., there can be seen a tendency of blocking to be easily caused, and if Tg is over 70° C., there can be seen a tendency of the softening point to be raised and a tendency of the fixing property to be lowered. If the acid value is less than 1, there can be seen a tendency of the reaction amount per one molecule to be small, and a tendency of the molecular weight to become hard to be high, and a tendency of the offset resistance to become also hard to be high. And if the acid value is over 30 mg KOH/g, there can be seen a tendency of gels to be easily cut during kneading in the production process of toner for electrophotography and also seen a tendency of the durable developing property and offset resistance to be lowered.

A toner binder for electrophotography relating to the present invention is produced by heating and melting a vinyl resin (A) containing glycidyl groups and a vinyl resin (B) containing carboxyl groups to be crosslinked, and contains 0.1 to 20% gel part, preferably 1 to 20% gel part, and further preferably 1 to 16% gel part. If the percentage of contained gel part to the toner binder for electrophotography is less than 0.1%, there can be seen a tendency of the effect of the offset resistance to become hard to be revealed. And if the percentage is over 20%, there can be seen a tendency of the fluidity to be lowered and a tendency of the fixing property at low temperatures corresponding to the high-speed movement of a copier to become hard to be obtained.

Furthermore, it is preferable to carry out the crosslink reaction using a vinyl resin (A) containing glycidyl groups of 0.01 to 1.0 equivalent weight, more preferably 0.02 to 0.8 equivalent weight, as a glycidyl group per one equivalent weight of carboxyl group in the vinyl resin (B) containing carboxyl groups.

As vinyl monomers containing a glycidyl group to be used in producing a vinyl resin (A) containing glycidyl groups that are used in the present invention, glycidyl acrylate, β-methylglycidyl acrylate, glycidyl methacrylate, β-methylglycidyl methacrylate and the like are good, and glycidyl methacrylate, β-methylglycidyl methacrylate are more preferable. These vinyl monomers containing a glycidyl group can be used alone or in combination of two or more kinds.

And as vinyl monomers containing a carboxyl group (including acid anhydride of unsaturated polybasic carboxylic acids) to be used in producing a vinyl resin (B) containing carboxyl groups that are used in the present invention, monoesters of unsaturated dibasic acids, including acrylic acid, methacrylic acid, maleicanhydride, maleic acid, fumaric acid, cinnamic acid, methyl fumarate, ethyl fumarate, propyl fumarate, butyl fumarate, octyl fumarate, methyl maleate, ethylmaleate, propylmaleate, butylmaleate, andoctylmaleate are good, and acrylic acid, methacrylic acid, fumaric acid, methyl fumarate, ethyl fumarate, propyl fumarate, butyl fumarate, octyl fumarate are more preferable. These vinyl monomers containing a carboxyl group can be used alone or in combination of two or more kinds.

As vinyl monomers to be copolymerized with a vinyl monomer containing a glycidyl group and a vinyl monomer containing a carboxyl group, there are, for example, styrenes, including styrene, p-methylstyrene, and α-methylstyrene; acrylates, including methyl acrylate, ethyl acrylate, propyl acrylate, butyl acrylate, octyl acrylate, cyclohexyl acrylate, stearyl acrylate, benzyl acrylate, furfuryl acrylate, hydroxyethyl acrylate, hydroxybutyl acrylate, dimethyl aminomethyl acrylate, and dimethyl aminoethyl acrylate; methacrylates, including methyl methacrylate, ethyl methacrylate, propyl methacrylate, butyl methacrylate, octyl methacrylate, cyclohexyl methacrylate, stearyl methacrylate, benzyl methacrylate, furfuryl methacrylate, hydroxyethyl methacrylate, hydroxybutyl methacrylate, dimethyl aminomethyl methacrylate, and dimethyl aminoethyl methacrylate; diesters of unsaturated dibasic acids, including dimethyl fumarate, dibutyl fumarate, dioctyl fumarate, dimethyl maleate, dibutyl maleate, and dioctyl maleate; and amides, including acrylonitrile, methacrylonitrile, acrylamide, methacrylamide, N-substituted acrylamide, and N-substituted methacylamide; and at least one of these vinyl monomers is used. Among them, especially preferable monomers include styrenes, acrylates, methacrylates, dialkyl fumarates, acrylonitrile, acrylamide, methacrylamide and the like. These vinyl monomers can be used alone or in combination of two or more kinds.

Number-average molecular weight and weight-average molecular weight in the present invention are reduced molecular weights that are measured by the GPC method and calibration curves are prepared with monodisperse standard polystyrene. The measurement conditions are as follows:

GPC device; JASCO TWINCLE HPLC

DETECTOR; SHODEX RI SE-31

COLUMN; SHODEX GPCA-80M*2+KF-802

Solvent; TETRAHYDROFURAN

Flow rate; 1.2 ml/min.

The percentage of gel part in the present invention will be defined with values measured as the following. That is, 2.5 g of a resin and 47.5 g of ethyl acetate are put in a 100 ml sample tube, and after being stirred at the revolution of 50 rpm and at 22° C. for 12 hours, the sample tube is left at rest at 22° C. for 12 hours. Then, after 5 g of the supernatant liquid in the sample tube is dried at 150° C. for 1 hour, the mass of the product is weighed (Xg), and the calculation is made according to the following formula.

$$\textit{Gel part}\ (\%)=\{(2.5/50-X/5)/(2.5/50)\}\times 100$$

Concerning the aspect of producing toner binder for electrophotography using polymer (A) and (B) of the present invention, that is, a vinyl resin (B) containing carboxyl groups and a vinyl resin (A) containing glycidyl groups, a method shown in the following and the like can be adopted. That is, a vinyl resin (A) containing glycidyl groups is mixed with a vinyl resin (B) containing carboxyl groups in a Henschel mixer and the like, and they are melt and kneaded with the use of a biaxial kneader to carry out the crosslink reaction of a carboxyl group and a glycidyl group.

At this time, in the crosslink reaction of resin (A) and resin (B), atoner binder for electrophotography with remaining crosslinking reactivity is made by stopping the crosslink reaction in the middle of the reaction, thus the produced toner binder would improve the fixing property because of its lower-viscosity. And further in the crosslink reaction, gel part is made to be 1% to 50% in the case where the crosslink reaction is completed (this maybe expressed as the completely reacted gel part), preferably to be 1% to 45%, and further preferably to be 5% to 45% in order to cause a crosslink reaction in time of fixing with this remained crosslink reactivity. (This may be expressed as the degree of crosslinking reaction, that is, it is defined by the following, degree of crosslinking reaction (%)=(gel part (%)/completely reacted gel part (%))×100.) For this purpose, it is preferable to melt and knead the resins at the residence time of 90 to 180 seconds when the resin temperature in the discharge opening of the biaxial kneader is 165 to less than 190° C., and at a residence time of less than 90 seconds when the resin temperature in the discharge opening of the biaxial kneader is 190 to 200° C.

Further, a gel part when the resins are reacted at the resin temperature of 220° C. in the discharge opening of the biaxial kneader for 180 seconds in kneading time is defined to be the gel part in cases where this crosslink reaction is made to be completed, that is, the completely reacted gel part.

A resin obtained in this manner is cooled and ground to make a toner binder for electrophotography. Though any methods of cooling and grinding that are conventionally known can be adopted, as a cooling method, it is preferable to quench the resin using a steel belt cooler and the like.

As a method of melting and kneading resin (A) and resin (B) for their crosslink reaction in the present invention, any conventionally known methods that can heat and melt resins can be adopted, but a method using a biaxial kneader is preferable.

In a toner binder for electrophotography that is obtained according to the present invention, when the viscoelasticity is measured in the temperature range of 50 to 200° C. and at the temperature rise speed of 2° C./min., in a viscoelasticity curve in the temperature range of 100 to 200° C. showing the relationship between the storage modulus and temperature, in which curve the axis of ordinate is the logarithm (Pa) of storage modulus G' and the axis of abscissa is temperature (° C.), the viscoelasticity curve is concave in the temperature range of 140° C. to 180° C. and has a minimum value of storage modulus G' at the bottom of the range, storage modulus G' 200 at 200° C. is preferably 1000 Pa to 50000 Pa, more preferably 2000 Pa to 40000 Pa, and further preferably 3000 Pa to 30000 Pa, and this G' 0 and storage modulus G' 200 at 200° C. are G' 0<G' 200 and the difference ΔG' (G' 200−G' 0=ΔG') is preferably 300 Pa to 50000 Pa, more preferably 400 Pa to 40000 Pa, and further preferably 500 Pa to 30000 Pa.

If the storage modulus G' 200 is less than 1000 Pa, there can be seen a tendency of viscosity at high temperatures to be lowered and a tendency of offset resistance to become difficult to be made sufficient. Further, if ΔG' is less than 300 Pa, there can be seen a tendency of the fixing property and the offset resistance to become difficult to be balanced, and a tendency of the fixing property at lower temperature to be excellent and a tendency of both of the fixing property and the offset resistance to be difficult to achieve in a well balanced state.

Moreover, the Tg of a toner binder for electrophotography of the present invention is preferably 45 to 75° C., more preferably 45 to 70° C., and further preferably 50 to 65° C., and the soluble part in tetrahydrofuran (THF) of the above describe toner binder for electrophotography has a peak preferably in the molecular weight range of 4,000 to 50,000, more preferably in the range of 6,000 to 40,000, and further preferably in the range of 8,000 to 30,000 in the molecular weight distribution according to gel permeation chromatography (GPC).

If the Tg is less than 45° C., there can be seen a tendency of blocking to be easily caused, and if Tg is over 75° C. or the peak of the molecular weight is over 50,000, there can be seen a tendency of the resin to be hard and a tendency of the fixing property to be lowered. And, if the peak of the molecular weight is less than 4,000, there can be seen a tendency of the offset to easily occur.

A toner binder for electrophotography in the present invention can be made to be a toner for electrophotography together with a coloring agent, if necessary, further with a charge control agent, are lease agent and a pigment dispersant, by the use of a known method.

As coloring agents, there are, for example, black pigments, including carbon black, acetylene black, lampblack, and magnetite; chrome yellow; yellow iron oxide; and known organic and inorganic pigments, including Hansa yellow G, quinoline yellow lake, permanent yellow NCG, molybdate orange, Vulcan orange, indanthrene, brilliant orange GK, iron red, brilliant carmine 6B, Frizaline lake, methyl violet lake, fast violet B, cobalt blue, alkali blue lake, phthalocyanine blue, fast sky blue, pigment green B, malachite green lake, titanium oxide, and zinc white. The amount of a coloring agent is usually 5 to 250 mass parts to 100 mass parts of a toner binder for electrophotography of the present invention.

Moreover, if necessary, for example, polyvinyl acetate, polyolefin, polyesters, polyvinyl butyral, polyurethane, polyamides, rosin, denatured rosin, terpene resins, phenol resins, aliphatic hydrocarbon resins, aromatic petroleum resins, paraffin waxes, polyolefin waxes, aliphatic amide waxes, vinyl chloride resins, styrene-butadiene resins, chroman-indene resins, melamine resins or others may be partly added and used in the range of not impeding the effect of the present invention.

Furthermore, any of known charge control agents of nigrosine, quaternary ammonium salt, metal containing azo dyes and others can be properly selected and used. The amount to be used is usually 0.1 to 10 mass parts to 100 mass parts of a binder resin for electrophotography of the present invention.

As a production method of toner for electrophotography of the present invention, any known methods can be adopted. For example, after a toner binder for electrophotography of the present invention, a coloring agent, a charge adjuster, a wax and others are premixed in advance, the mixture is kneaded in a heated and melted state in a biaxial kneader, then the kneaded mixture is pulverized with the use of a pulverizer after being cooled and is further classified with an air classifier, and usually particles in the range of 8 to 20 μm are collected and made to be toner for electrophotography. However, concerning heating and melting conditions in the biaxial kneader, it is preferable that resin temperature in the discharge opening of the biaxial kneader is less than 165° C. and the residence time is less than 180 seconds. And as a cooling method, quenching with the use of a steel belt cooler and the like is preferable.

In the toner for electrophotography that is obtained according to the above described method, a toner binder for electrophotography of the present invention is contained in the amount of 50 mass % or more, preferably in the amount of 60 mass % or more. There is no upper limit in the amount, and the amount is adjusted according to the purpose and usually possible to be adjusted up to 90 to 100 mass %.

The measurement of viscoelasticity in the present invention was carried out according to the following measuring method.

Viscoelasticity device: STRESS TECH rheometer (Rheologica Co., Ltd.)

Measurement mode: Oscillation strain control

Temperature range in measurement: 50 to 200° C.

Heating rate: 2° C./min.

Frequency: 1 Hz

Gap: 1 mm

Plate: Parallel plate

Stress strain: 1%

EXAMPLES

The present invention will be described concretely by the following examples, but the examples are not intended to limit the present invention. Moreover, "part" hereafter will show mass part as long as especially indicated.

PRODUCTION EXAMPLES OF VINYL RESIN (A) CONTAINING GLYCIDYL GROUPS

Production example A-1

Seventy five parts of xylene was put in a flask, in which nitrogen had been substituted for air, and was heated, and a previously mixed and dissolved mixture of 65 parts of styrene, 30 parts of n-butyl acrylate, 5 parts of glycidyl methacrylate, and 1 part of di-t-butyl peroxide was continuously added for 5 hours under the reflux of xylene, and the reflux was further continued for 1 hour. Then, the inner temperature was kept at 130° C., and the reaction was completed by carrying out two times the polymerization of the remained monomers for 2 hours. As a result, a polymerization liquid was obtained. The liquid was flashed in a vessel in which the temperature was kept at 160° C. and the pressure at 10 mm Hg to remove solvent and the like. Values of physical properties of the obtained vinyl resin are shown in Table 1.

Production example A-2

A vinyl resin was obtained in the exact same method as that in production example A-1 except that di-t-butyl peroxide was changed from 1 part to 0.4 parts, glycidyl methacrylate was changed from 5 parts to 13 parts and styrene was changed from 65 parts to 57 parts. Values of physical properties of the obtained resin are shown in Table 1.

Production example A-3

Forty parts of xylene was put in a flask, in which nitrogen had been substituted for air, and was heated with an oil bath, then a solution of 68 parts of styrene, 27 parts of n-butyl acrylate, 5 parts of glycidyl methacrylate, and 4 parts of di-t-butyl peroxide was continuously dropped for 5 hours under the reflux of xylene (inner temperature was 138° C.). After that, after the polymerization reaction was continued for one hour, 0.5 parts of di-t-butyl peroxide was added and the reaction was continued for 2 hours while the inner temperature was kept at 130° C. until the end of the polymerization.

Values of physical properties of the obtained resin are shown in Table 1.

PRODUCTION EXAMPLES OF VINYL RESIN (B) CONTAINING CARBOXYL GROUPS

Production example B-1

A mixture in which 0.6 parts of di-t-butyl peroxide per 100 parts of styrene had been uniformly dissolved in a solution comprising of 57.4 parts of styrene, 11.9 parts of n-butyl acrylate, 0.7 parts of methacrylic acid and 30 parts of xylene was continuously fed at the rate of 750 cc/hr into a 5 liter reactor, which was kept at the inner temperature of 190° C. and at the inner pressure of 6 kg/cm$^2$, to be polymerized. A low molecular weight polymerization liquid was thus obtained.

Separately, as vinyl monomers, 75 parts of styrene, 23.5 parts of n-butyl acrylate, and 1.5 parts of methacrylic acid were put in a flask, in which nitrogen had been substituted for air, and the inner temperature of the flask was raised to 120° C. and the bulk polymerization was carried out for 10 hours while keeping the inner temperature. The conversion of the polymerization was 51% at this time. Then, 50 parts of xylene was added, and a previously mixed and dissolved solution of 0.1 parts of dibutyl peroxide in 50 parts of xylene was continuously added for 8 hours while keeping the inner temperature at 130° C. and the remained monomers were further polymerized for 2 hours until the completion of the polymerization. As a result, a high molecular weight polymerization liquid was obtained.

Then, after 100 parts of the above described low molecular weight polymerization liquid and 60 parts of the above described high molecular weight polymerization liquid were mixed, the mixture was flashed in a vessel in which the temperature was kept at 160° C. and the pressure at 10 mm Hg to remove the solvent and the like. Values of physical properties of the obtained vinyl resin are shown in Table 1.

Production example B-2

A vinyl resin was obtained in the exact same method as that in production example B-1 except that styrene was changed from 57.4 parts to 54.6 parts and methacrylic acid was changed from 0.7 parts to 3.5 parts in case of producing a low molecular weight polymerization liquid in production example B-1. Values of physical properties of the obtained resin are shown in Table 1.

Production example B-3

A vinyl resin was obtained in the exact same method as that in production example B-1 except that styrene was changed from 57.4 parts to 50.4 parts and n-butyl acrylate was changed from 11.9 parts to 18.9 parts in case of producing a low molecular weight polymerization liquid in production example B-1. Values of physical properties of the obtained resin are shown in Table 1.

Production example B-4

One hundred parts of xylene was put in a flask, in which nitrogen had been substituted for air, and was heated with an oil bath, then a solution of 82 parts of styrene, 17 parts of n-butyl acrylate, 1 part of methacrylic acid, and 3 parts of t-butyl peroxy 2-ethyl hexanoate was continuously dropped for 5 hours under the reflux of xylene (inner temperature was 138° C.). After the polymerization reaction was continued for one hour, 0.3 parts of t-butyl peroxy 2-ethyl hexanoate was added and the reaction was continued for one hour and further 0.5 parts of t-butyl peroxy 2-ethyl hexanoate was added and the polymerization reaction was continued for two hours while keeping the inner temperature at 98° C. A low molecular weight polymerization liquid was thus obtained.

Separately, 74 parts of styrene and 23.5 parts of n-butyl acrylate were put in a flask, in which nitrogen had been substituted for air, and was bulk polymerized for 6 hours while the inner temperature was kept at 120° C. by heating with an oil bath. The conversion of the bulk polymerization was 40%. After the bulk polymerization, 50 parts of xylene and 2.5 parts of methacrylic acid were added, and a solution of 0.34 parts of 1,1-bis (t-butyl peroxy) 3,3,5-trimethyl cyclohexane and 60 parts of xylene was continuously dropped for 9 hours while keeping the inner temperature at 110° C. After that, after the polymerization reaction was continued for two hours, 0.2 parts of di-t-butyl peroxide was added and the reaction was continued for two hours and further 0.5 parts of di-t-butyl peroxide was added and the reaction was continued for two hours while keeping the inner temperature at 130° C. Then, the reaction mixture was diluted with 123.33 parts of xylene and the polymerization was ended. As a result, a high molecular weight polymerization liquid was obtained.

Then, 100 parts of the above described low molecular weight polymerization liquid and 70.3 parts of the above described high molecular weight polymerization liquid were mixed, and the mixture was flashed in a vessel in which the temperature was kept at 190° C. and the pressure at 10 mm Hg to remove the solvent. Values of physical properties of the obtained resin are shown in Table 1.

EXAMPLE 1

After 3 parts of the vinyl resin obtained in production example A-1 and 97 parts of the vinyl resin obtained in production example B-1 were mixed in a Henschel mixer, the mixed resin was kneaded and reacted in a biaxial kneader (KEXN S-40 type, made by Kurimoto, Ltd.) where the resin temperature in the discharge opening of the biaxial kneader was 170° C. and the residence time was 90 seconds. After that, the kneaded product was cooled and ground to make a toner binder for electrophotography. Using a steel belt cooler as a cooling method, the kneaded product was quenched with the cooler of 0.08 kcal/mhrs in thermal conductivity under the condition that the temperature of cooling water was 10° C. and the amount of cooling water was 20 liter per 1 kg of the resin (*). Various conditions and values of physical properties of the obtained resin are shown in Table 1. After that, 6 part of carbon black, REGAL (a trade mark) 330R (made by CABOT CORPORATION), 2.5 parts of polypropylene wax, NP105 (made by Mitsui Chemicals, Inc.), and 1 part of Bontron S34 (made by Orient Chemical Industries, Ltd.) as a charge adjuster were added in the resin, and they were mixed again in a Henschel mixer and then kneaded in a biaxial kneader (PCM-30 type, made by Ikegai Kikai, Co., Ltd.) under the condition that the resin temperature in the discharge opening of the biaxial kneader was 150° C. and the residence time was 30 seconds. Subsequently, the kneaded product was cooled, ground, and classified to make toner of about 7 microns for electrophotography. This cooling was carried out in the same quenching method as that indicated in the above (*) part. Three parts of this toner for electrophotography and 97 parts of a carrier were mixed to make a developer. A commercially available high-speed copier was altered and the developer was evaluated by producing images with the copier. The results are shown in Table 1.

EXAMPLE 2

The example was carried out in the exact same method as that in Example 1 except that the resin temperature in the discharge opening of the biaxial kneader was 185° C. Various conditions, values of physical properties of the resin, and those results are shown in Table 1.

EXAMPLE 3

The example was carried out in the exact same method as that in Example 2 except that the vinyl resin obtained in production example A-1 was 7 parts and the vinyl resin obtained in production example B-1 was 93 parts. Various conditions, values of physical properties of the resin, and those results are shown in Table 1.

EXAMPLE 4

The example was carried out in the exact same method as that in Example 1 except that the resin temperature in the discharge opening of the biaxial kneader was 200° C. and the residence time was 30 seconds. Various conditions, values of physical properties of the resin, and those results are shown in Table 1.

EXAMPLE 5

The example was carried out in the exact same method as that in Example 2 except that the vinyl resin obtained in production example A-1 was changed to the vinyl resin obtained in production example A-2. Various conditions, values of physical properties of the resin, and those results are shown in Table 1.

EXAMPLES 6, 7

These examples were carried out in the exact same method as that in Example 2 except that the vinyl resin obtained in production example B-1 was changed to the vinyl resins obtained in production examples B-2 and B-3 for Example 6 and Example 7, respectively. Various conditions, values of physical properties of the resin, and those results are shown in Table 1.

EXAMPLE 8

The example was carried out in the exact same method as that in Example 1 except that the mixing ratio of the vinyl resin obtained in production example A-2 and the vinyl resin obtained in production example B-1 was 97/3. Various conditions, values of physical properties of the resin, and those results are shown in Table 1.

EXAMPLE 9

The example was carried out in the exact same method as that in Example 2 except that the mixing ratio of the vinyl resin obtained in production example A-1 and the vinyl resin obtained in production example B-1 was changed from 97/3 to 94/6. Various conditions, values of physical properties of the resin, and those results are shown in Table 1.

EXAMPLE 10

Figure 4:
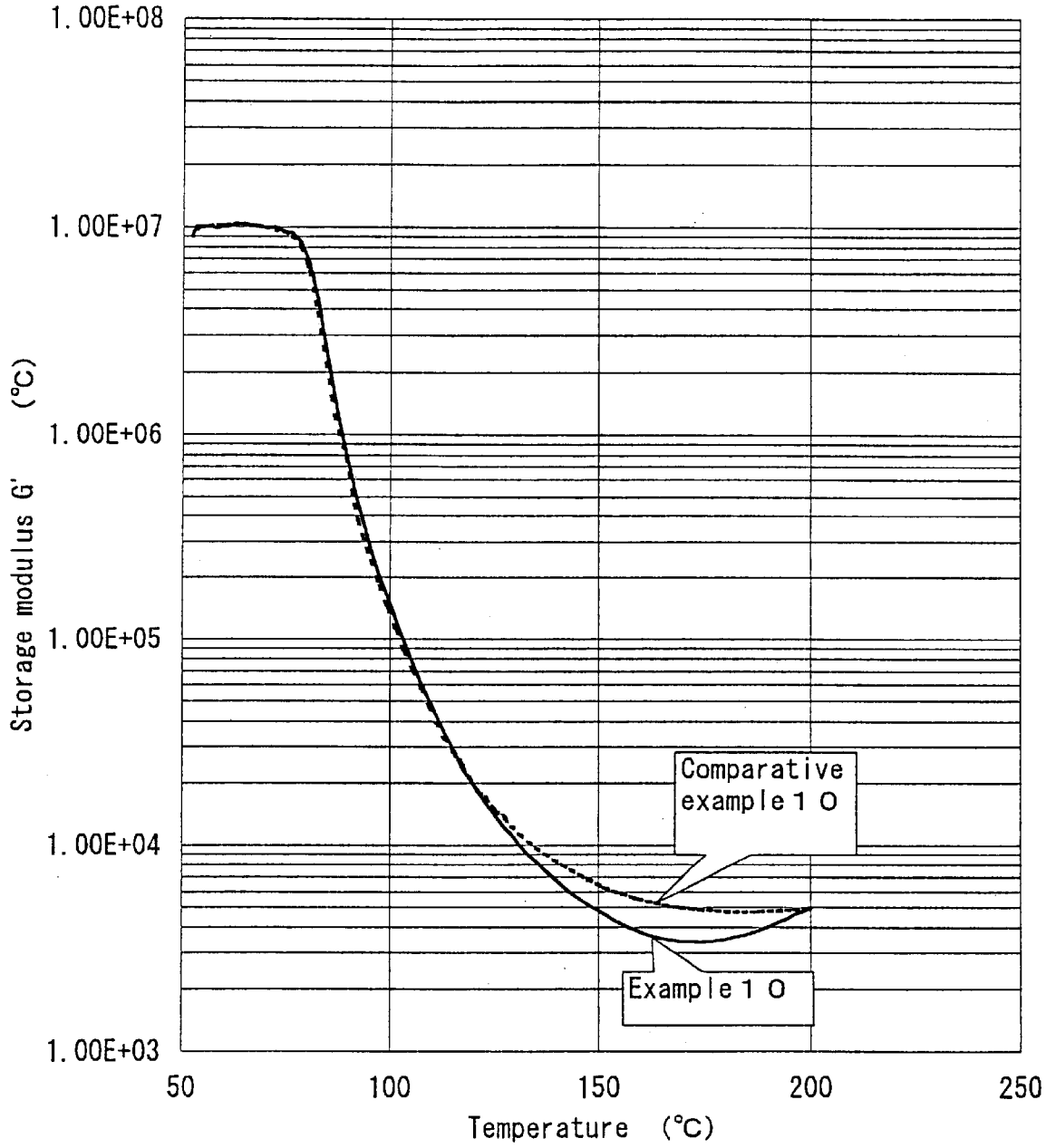
FIG. 4 is a figure showing the relationships between the storage modulus G's of toner binders and temperatures in Example 10 and Comparative example 10.

After 93 parts of the vinyl resin obtained in production example B-4 and 7 parts of the vinyl resin obtained in production example A-3 were mixed in a Henschel mixer, the mixed resin was kneaded and reacted in a biaxial kneader (KEXN S-40 type, made by Kurimoto, Ltd.) under the condition that the resin temperature in the discharge opening of the biaxial kneader was 185° C. and the residence time was 90 seconds. The obtained resin was cooled and ground with a grinder (Power mill type P-3, made by Sanei Factory, Co.) to produce a toner binder for electrophotography. As the cooling method, a quenching method similar to Example 1 was used. In this toner binder for electrophotography, 6 part of carbon black, REGAL (a trade mark) 330R (made by CABOT CORPORATION), 2.5 parts of polypropylene wax, NP105 (made by Mitsui Chemicals, Inc.), and 1 part of Bontron S34 (made by Orient Chemical Industries, Ltd.) as a charge adjuster were added, and they were mixed again in a Henschel mixer and then kneaded in a biaxial kneader (PCM-30 type, made by Ikegai Kikai, Co., Ltd.) where the resin temperature in the discharge opening of the biaxial kneader was 155° C. and the residence time was 60 seconds. Subsequently, the kneaded product was cooled, ground, and classified to make toner of about 7 microns for electrophotography. In this cooling, a quenching method similar to Example 1 was used. Three parts of this toner for electrophotography and 97 parts of a carrier were mixed to make a developer. A commercially available high-speed copier was altered and the developer was evaluated by producing images with the copier. The measurement result of viscoelasticity of the obtained toner binder for electrophotography is shown in FIG. 4. Various conditions, values of physical properties of the resin, and those results are shown in Table 1.

Comparative example 1

A toner binder was obtained in the exact same method as that in Example 1 except that the kneading reaction was conducted under the condition that the resin temperature in the discharge opening of the biaxial kneader was 200° C. and the residence time was 90 seconds. And toner was obtained in the exact same method as that in Example 1 except for using the toner binder obtained in this example and was evaluated in the same method as that in Example 1. Various conditions, values of physical properties of the resin, and those results are shown in Table 2.

Comparative example 2

The example was carried out in the exact same method as that in Comparative example 1 except that the resin temperature in the discharge opening of the biaxial kneader was 220° C. Various conditions, values of physical properties of the resin, and those results are shown in Table 2.

Comparative example 3

The example was carried out in the exact same method as that in Comparative example 1 except that the vinyl resin obtained in production example A-1 was 7 parts and the vinyl resin obtained in production example B-1 was 93 parts. Various conditions, values of physical properties of the resin, and those results are shown in Table 2.

Comparative example 4

The example was carried out in the exact same method as that in Comparative example 1 except that the residence time was 180 seconds. Various conditions, values of physical properties of the resin, and those results are shown in Table 2.

Comparative example 5

The example was carried out in the exact same method as that in Comparative example 1 except that the vinyl resin obtained in production example A-1 was changed to the vinyl resin obtained in production example A-2. Various conditions, values of physical properties of the resin, and those results are shown in Table 2.

Comparative examples 6, 7

These examples were carried out in the exact same method as that in Comparative example 1 except that the vinyl resin obtained in production example B-1 was changed to the vinyl resins obtained in production examples B-2 and B-3 for Comparative example 6 and Comparative example 7, respectively. Various conditions, values of physical properties of the resin, and those results are shown in Table 2.

Comparative example 8

The example was carried out in the exact same method as that in Comparative example 1 except that the mixing ratio of the vinyl resin obtained in production example A-2 and the vinyl resin obtained in production example B-1 was 97/3. Various conditions, values of physical properties of the resin, and those results are shown in Table 2.

Comparative example 9

The example was carried out in the exact same method as that in Comparative example 1 except that the mixing ratio of the vinyl resin obtained in production example A-1 and the vinyl resin obtained in production example B-1 was changed from 97/3 to 94/6. Various conditions, values of physical properties of the resin, and those results are shown in Table 2.

Comparative example 10

A toner binder was obtained in the exact same method as that in Example 10 except that the kneading reaction was conducted under the condition that the resin temperature in the discharge opening of the biaxial kneader was 220° C. and the residence time was 180 seconds. And toner was obtained in the exact same method as that in Example 10 except for using the toner binder obtained in this example. The measurement result of viscoelasticity of the obtained toner binder is shown in FIG. 4. Various conditions, values of physical properties of the resin, and those results are shown in Table 2.

THE EVALUATION METHOD OF TONER

1) Fixing property

Copies were made at a copy speed of 72 sheets/min as the temperature of the fixing roll was changed every five minutes. A sand eraser (a plastic sand eraser "MONO", made by Tombo Pencil Co., Ltd.) was made to go and return on an area between the thick black part and the white background on a copy 10 times under a constant force. The degree of blackness on the thick black part was measured with an ink concentration meter and the residual ratio of toner was expressed by the concentration ratio, and the minimum temperature at which toner remained at 60% or more (the temperature can be expressed as fixing temperature), was shown.

2) Offset resistance

Temperature at which offset occurs (the temperature can be expressed as offset temperature) in the case of copying was indicated as it is.

3) Blocking property

After toner was left alone for one week under the environment of 50° C. and 50% relative humidity, the degree of agglomeration of powder was measured by visual inspection as follows:

◎; Powder is not agglomerated at all.

○; Though powder is slightly agglomerated, the agglomeration loosens when the container is lightly shaken.

Δ; There are some agglomerates that will not loosen even if the container is shaken sufficiently.

X; Powder is completely agglomerated.

4) Grindability

When toner is produced, part of the product that had been kneaded in a biaxial kneader and cooled was taken and ground, and then the ground powder was made uniform in particle size of 10 mesh under and 16 mesh on and was further ground in a jet mill. The particle-size distribution was measured with a coal-tar counter and the ratio of the particle size of 5 to 20 μ was obtained.

◎; 85% or more.

○; 70 to 85%.

Δ; 50 to 70%.

X; less than 50%.

5) Durable developing property

After 10000 sheets were continuously copied with a commercially available high-speed copier (copy speed of 72 sheets/min.), patterns were copied to check the reproducibility. Concerning a base paper on which there is a line of 100 μm in line width, the line width was measured at 5 points by observing with a microscope. Further the paper was copied, and the line width was measured at 5 points on the copied paper after being fixed. The average values of the line widths on the base paper and the copied paper were obtained respectively, and the evaluation was conducted as the following, according to the difference between the line width on the base paper and that on the copied paper. The increase in line width δ=the line width on the copied paper −the line width on the base paper.

○; $\delta<5$ μm

Δ; $5\leqq\delta<10$ μm

X; $\delta\geqq10$ μm

TABLE 1

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Resin A | A-1 | A-1 | A-1 | A-1 | A-2 | A-1 | A-1 | A-2 | A-1 | A-3 |
| Resin B | B-1 | B-1 | B-1 | B-1 | B-1 | B-2 | B-3 | B-1 | B-1 | B-4 |
| Weight ratio (B/A) | 97/3 | 97/3 | 93/7 | 97/3 | 97/3 | 97/3 | 97/3 | 93/7 | 94/6 | 93/7 |
| Resin A Mw | 30000 | 30000 | 30000 | 30000 | 70000 | 30000 | 30000 | 70000 | 30000 | 50000 |
| Resin A Epoxy value (Eq/100 g) | 0.039 | 0.039 | 0.039 | 0.039 | 0.1 | 0.039 | 0.039 | 0.1 | 0.039 | 0.039 |
| Resin B Acid value (mg KOH/g) | 7.3 | 7.3 | 7.3 | 7.3 | 7.3 | 24.5 | 7.3 | 7.3 | 7.3 | 8.9 |
| Resin B Tg (° C.) | 58 | 58 | 58 | 58 | 58 | 60 | 51 | 58 | 58 | 60 |
| Resin temperature in the biaxial kneader | 170 | 185 | 185 | 200 | 185 | 185 | 185 | 170 | 185 | 185 |
| Residence time in the biaxial kneader | 90 | 90 | 90 | 30 | 90 | 90 | 90 | 90 | 90 | 90 |
| Peak value in molecular weight (×10000) | 1.2 | 1.2 | 1.2 | 1.2 | 1.2 | 1.2 | 1.2 | 1.2 | 1.2 | 1.6 |
| Completely reacted gel part (%).. X | 18 | 17 | 45 | 17 | 33 | 10 | 18 | 30 | 40 | 21 |
| Gel part (%)..Y | 4 | 6 | 15 | 6 | 10 | 3 | 8 | 10 | 10 | 8 |
| Degree of crosslinking reaction ..Y/X*100 (%) | 22 | 35 | 33 | 35 | 30 | 30 | 44 | 33 | 25 | 38 |
| Tg (° C.) | 59 | 60 | 61 | 60 | 60 | 61 | 53 | 60 | 60 | 60 |
| G' 0 (Pa) | 3050 | 3300 | 4600 | 3300 | 3980 | 3300 | 3750 | 3900 | 4430 | 3420 |
| G' 200 (Pa) | 4750 | 4800 | 6200 | 4800 | 5560 | 4400 | 4800 | 5600 | 6000 | 5000 |
| ΔG' (Pa) | 1700 | 1500 | 1600 | 1500 | 1580 | 1100 | 1050 | 1700 | 1570 | 1580 |
| Temperature at G' 0 (° C.) | 166 | 172 | 168 | 173 | 170 | 176 | 175 | 167 | 170 | 172 |
| Fixing temperature (° C.) | 150 | 154 | 175 | 154 | 170 | 154 | 160 | 163 | 173 | 156 |
| Offset temperature (° C.) | 220 | 220 | 240 | 220 | 235 | 210 | 215 | 235 | 240 | 225 |
| Blocking property | ○ | ◎ | ◎ | ◎ | ○ | ◎ | Δ | ◎ | ○ | ◎ |
| Grindability (%) | 94 | 91 | 80 | 91 | 87 | 92 | 91 | 86 | 82 | 89 |
| Durable developing property | ○ | ○ | ○ | ○ | ○ | ○ | ○ | ○ | ○ | ○ |

TABLE 2

| | Comparative example 1 | Comparative example 2 | Comparative example 3 | Comparative example 4 | Comparative example 5 | Comparative example 6 | Comparative example 7 | Comparative example 8 | Comparative example 9 | Comparative example 10 |
|---|---|---|---|---|---|---|---|---|---|---|
| Resin A | A-1 | A-1 | A-1 | A-1 | A-2 | A-1 | A-1 | A-2 | A-1 | A-3 |
| Resin B | B-1 | B-1 | B-1 | B-1 | B-1 | B-2 | B-3 | B-1 | B-1 | B-4 |
| Weight ratio (B/A) | 97/3 | 97/3 | 93/7 | 97/3 | 97/3 | 97/3 | 97/3 | 93/7 | 94/6 | 93/7 |
| Resin A Mw | 30000 | 30000 | 30000 | 30000 | 70000 | 30000 | 30000 | 70000 | 30000 | 50000 |
| Resin A Epoxy value (Eq/100 g) | 0.039 | 0.039 | 0.039 | 0.039 | 0.1 | 0.039 | 0.039 | 0.1 | 0.039 | 0.039 |
| Resin B Acid value (mg KOH/g) | 7.3 | 7.3 | 7.3 | 7.3 | 7.3 | 24.5 | 7.3 | 7.3 | 7.3 | 8.9 |
| Resin B Tg (° C.) | 58 | 58 | 58 | 58 | 58 | 60 | 51 | 58 | 58 | 60 |
| Resin temperature in the biaxial kneader | 200 | 220 | 200 | 200 | 200 | 200 | 200 | 200 | 200 | 220 |
| Residence time in the biaxial kneader | 90 | 90 | 90 | 180 | 90 | 90 | 90 | 90 | 90 | 180 |

TABLE 2-continued

| | Comparative example 1 | Comparative example 2 | Comparative example 3 | Comparative example 4 | Comparative example 5 | Comparative example 6 | Comparative example 7 | Comparative example 8 | Comparative example 9 | Comparative example 10 |
|---|---|---|---|---|---|---|---|---|---|---|
| Peak value in molecular weight (×10000) | 1.2 | 1.2 | 1.2 | 1.2 | 1.2 | 1.2 | 1.2 | 1.2 | 1.2 | 1.6 |
| Completely reacted gel part (%).. X | 18 | 17 | 45 | 17 | 33 | 10 | 18 | 30 | 40 | 21 |
| Gel part (%) ..Y | 17 | 17 | 42 | 16 | 31 | 9.5 | 17 | 28 | 38 | 21 |
| Degree of crosslinking reaction Y/X*100 (%) | 94 | 100 | 93 | 94 | 94 | 95 | 94 | 93 | 95 | 100 |
| Tg (° C.) | 59 | 60 | 61 | 60 | 60 | 61 | 53 | 60 | 60 | 60 |
| G' 0 (Pa) | 4770 | 4850 | 6100 | 4730 | 5500 | 4350 | 4750 | 5540 | 5950 | 4970 |
| G' 200 (Pa) | 4750 | 4800 | 6200 | 4800 | 5560 | 4400 | 4800 | 5600 | 6000 | 5000 |
| ΔG' (Pa) | −20 | −50 | 100 | 70 | 60 | 50 | 50 | 60 | 50 | 30 |
| Temperature at G' 0 (° C.) | — | — | 177 | 179 | 180 | 186 | 185 | 181 | 185 | 184 |
| Fixing temperature (° C.) | 180 | 187 | 200 | 185 | 192 | 171 | 182 | 193 | 194 | 187 |
| Offset temperature (° C.) | 215 | 215 | 240 | 215 | 230 | 210 | 215 | 230 | 240 | 220 |
| Storage property | ○ | ◎ | ◎ | ◎ | ○ | ◎ | Δ | ◎ | ○ | ◎ |
| Grindability (%) | 90 | 87 | 72 | 87 | 83 | 90 | 89 | 79 | 75 | 70 |
| Durable developing property | ○ | Δ | ○ | Δ | Δ | Δ | Δ | ○ | ○ | ○ |

The results of the examples are shown in Table 1, and the results of the comparative examples are shown in Table 2. The relationship between the gel part and the fixing temperature in examples and comparative examples is shown in FIG. 1. The relationship between the completely reacted gel part and the offset temperature in examples and comparative examples is shown FIG. 2. The relationship between the fixing temperature and the offset temperature in examples and comparative examples is shown FIG. 3.

Figure 2:
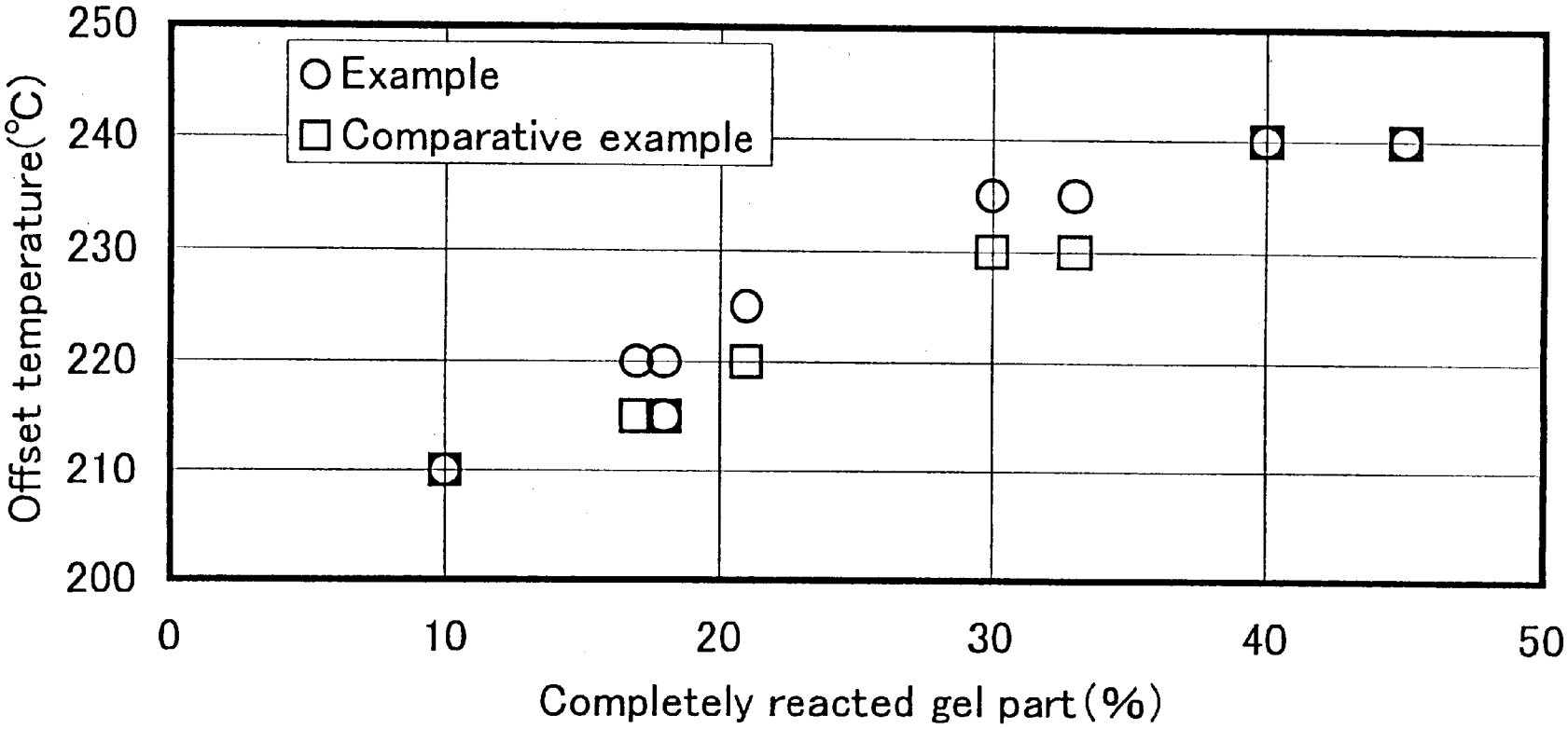
FIG. 2 is a figure showing the relationships between completely reacted gel part and offset temperature in examples and comparative examples.

The present inventors have eagerly studied and found that there is a strong correlation between the gel part and the fixing temperature as shown in FIG. 1 and also a strong correlation between the completely reacted gel part and the offset temperature as shown in FIG. 2. Moreover, as being described in detail in the part of mode for carrying out the invention, the present inventors have found that the gel part can be controlled by controlling the crosslink reaction in the biaxial kneading process, and as a result, they have obtained a method to get a desired fixing property. On the other hand, it is possible to control the completely reacted gel part with the use of the known technique developed by the present inventors (Japanese Patent Laid-Open No. 09-319140), and as a result, a desired offset property could be obtained using the relationship shown in FIG. 2.

Figure 3:
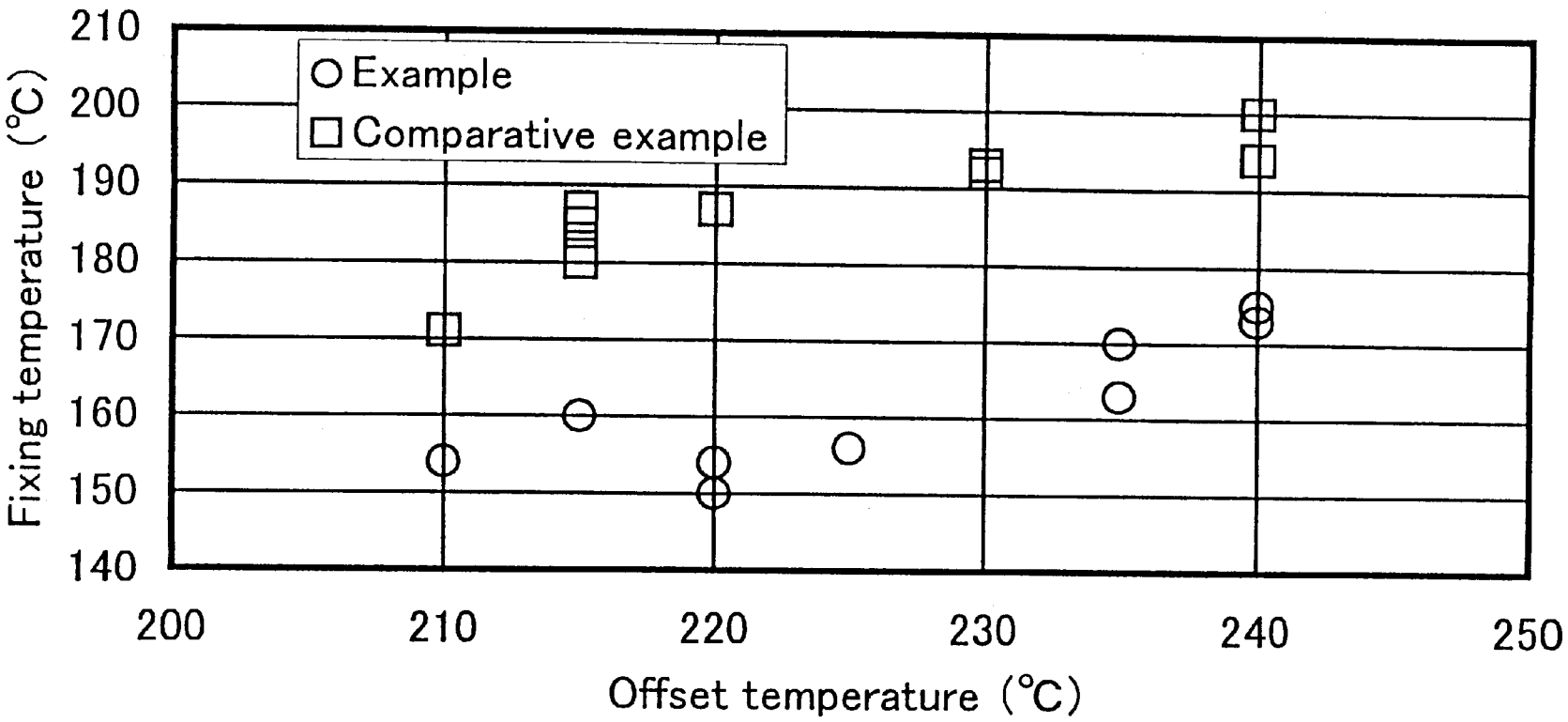
FIG. 3 is a figure showing the relationships between fixing temperature and offset temperature in examples and comparative examples.

As mentioned above, the present inventors have obtained a method to get a toner binder that is excellent in the fixing property in lower temperatures and excellent in the offset property by controlling both of the gel part and the completely reacted gel part. As shown in FIG. 3, it can be seen that in examples as compared to comparative example, in case of the same fixing temperature, a toner binder with higher offset temperature can be obtained, and in case of the same offset temperature, a toner binder with lower fixing temperature can be obtained.

A toner binder of the present invention has properties that correspond to energy-saving high-speed machines, that is excellence in the fixing property in low temperature and also excellence in the offset resistance. Furthermore, a toner binder of the present invention has such excellent practical capacity that it is excellent in the blocking property, grindability and the durable developing property as shown in Table 1.

What is claimed is:

1. A toner binder for electrophotography wherein when the viscoelasticity of said toner binder is measured in the temperature range of 50 to 200° C. and at a heating rate of 2° C./min., the viscoelasticity curve in the temperature range of 100 to 200° C. showing the relationship between the storage modulus and temperature, in which curve the axis of ordinate is the logarithm (Pa) of storage modulus G' and the axis of abscissa is temperature (° C.), has a concave in the temperature range of 140° C. to 180° C. and has a minimum value of storage modulus G' at the bottom of the range, and this G' 0 and the storage modulus G' 200 at 200° C. have a relationship of G' 0<G' 200 and the difference ΔG' (G' 200 −G' 0=ΔG') is 300 Pa or more and said toner has a degree of crosslinking reaction of 1 to 50%, a glass transition temperature of 45 to 75° C., contains 0.1 to 20 mass % gel part, and has a peak in the molecular weight area of 4,000 to 50,000 in the molecular weight distribution based on gel permeation chromatography (GPC) of the soluble part of said toner binder in tetrahydrofuran (THF).

2. The toner binder for electrophotography according to claim 1, wherein said storage modulus G' 200 at 200° C. is 1000 Pa or more.

3. The toner binder for electrophotography according to claim 1, wherein said toner binder is obtained by heating and melting a vinyl resin (A) containing glycidyl groups, the weight-average molecular weight of which resin is 10,000 to 100,000 and the epoxy value of which resin is 0.005 to 0.1 Eq/100 g, and a vinyl resin (B) containing carboxyl groups, the acid value of which resin is 1 to 30 mg KOH/g and the glass transition temperature of which resin is 40 to 70° C., to be crosslinked by the use of said vinyl resin (A) containing lycidyl groups as a crosslinking agent.

4. The toner binder for electrophotography according to claim 1, wherein one of styrene-acrylic resins is a main component.

5. Toner for electrophotography, wherein the toner binder for electrophotography according to claim 1 is used.

6. Toner for electrophotography, wherein the toner binder for electrophotography according to claim 2 is used.

7. The toner binder for electrophotography according to claim 2, wherein said toner binder is obtained by heating and melting a vinyl resin (A) containing glycidyl groups, the weight-average molecular weight of which resin is 10,000 to 100,000 and the epoxy value of which resin is 0.005 to 0.1 Eq/100 g, and a vinyl resin (B) containing carboxyl groups, the acid value of which resin is 1 to 30 mg KOH/g and the glass transition temperature of which resin is 40 to 70° C., to be crosslinked by the use of said vinyl resin (A) containing glycidyl groups as a crosslinking agent.

8. The toner binder for electrophotography according to claim 2, wherein one of styrene-acrylic resins is a main component.

9. Toner for electrophotography, wherein the toner binder for electrophotography according to claim 3 is used.

10. Toner for electrophotography, wherein the toner binder for electrophotography according to claim 4 is used.

* * * * *